US006868692B2

(12) United States Patent
Choi

(10) Patent No.: US 6,868,692 B2
(45) Date of Patent: Mar. 22, 2005

(54) DOOR FOR REFRIGERATOR

(75) Inventor: Chang-Bong Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/803,034

(22) Filed: Mar. 18, 2004

(65) Prior Publication Data

US 2004/0182104 A1 Sep. 23, 2004

(30) Foreign Application Priority Data

Mar. 20, 2003 (KR) ..... 10-2003-0017342
Mar. 20, 2003 (KR) ..... 10-2003-0017341

(51) Int. Cl.[7] ..... F25D 23/12
(52) U.S. Cl. ..... 62/389; 62/440; 220/146.6
(58) Field of Search ..... 62/389, 390, 440, 62/444, 447; 222/146.6, 189.09, 190, 504

(56) References Cited

U.S. PATENT DOCUMENTS 4,912,942 A * 4/1990 Katterhenry et al. ..... 62/338
5,359,795 A * 11/1994 Mawby et al. ..... 40/405
6,003,734 A * 12/1999 Oh ..... 222/146.6
6,303,031 B1 * 10/2001 Senner ..... 210/232

* cited by examiner

*Primary Examiner*—Melvin Jones
(74) *Attorney, Agent, or Firm*—Fleshner & Kim, LLP

(57) ABSTRACT

The present invention relates to a door for a refrigerator, and more particularly, to a door for use in a refrigerator in which a direction of opening and/or closing the door can be selectively changed. The door of the present invention comprises an external plate 80 which defines at least a front appearance of the door; a door liner 81 which defines a rear appearance of the door and constitutes a space with an insulating layer 83 formed therein in cooperation with the external plate 80; a dispenser 74 which is installed at a front surface of the external plate 80 for dispensing water to the outside of the refrigerator; tube passages 97 and 97' which pass through the insulating layer 83 and allow the dispenser 74 and through-holes 86 for installation of a hinge 57 located at both sides of the door to communicate with each other; a door side tube structure 72 which is installed in at least one of the tube passages 97 and 97' and transfers water from a main body 50 of the refrigerator to the dispenser 74; and a power cable 99 which extends from the dispenser 74 to the respective through-holes 86 and through which electrical signals are transmitted between the door 56 and the main body 50 of the refrigerator. According to the present invention, there are advantages in that the door opening/closing direction can be easily changed and the external appearance of the door can be cleanly and neatly finished.

18 Claims, 5 Drawing Sheets

DOOR FOR REFRIGERATOR

BACKGROUND OF THE INVENTION

1. Field of the Invention

The present invention relates to a door for a refrigerator, and more particularly, to a door for use in a refrigerator with a dispenser capable of dispensing water to the outside of the refrigerator.

2. Description of the Prior Art

FIG. 1 shows a front configuration of a related art refrigerator. As shown in this figure, a storage space such as refrigerating and freezing chambers is formed within a main body 10 of the refrigerator. The storage space is opened and/or closed by separate doors 12 and 14.

The door 12 is hinged on an end side thereof to the main body 10 of the refrigerator to be opened and/or closed. The door 14 is used to constitute a front face of a tray (i.e., a portion in which articles to be stored are secured) that is slid in and out in a drawer fashion. The door 14 is in close contact with the front face of the main body 10 of the refrigerator or pulled in a forward direction so as to open and/or close the storage space.

The doors 12 and 14 are provided with door handles 16 and 16', respectively. The door handles 16 and 16' are portions which users grasp to exert predetermined force when intending to open and/close the door 12 and 14, respectively. The door handle 16 of the door 12 is provided on the front face at a side opposite to the end side where a hinge is installed.

In the meantime, a dispenser 18, by which the user can directly catch water without opening the door 12 to take out the water stored in the refrigerator, is further provided on the front face of the door 12.

Since the dispenser 18 is installed at the front face of the door 12, a water supply tube 20 should be provided in the door 12 to supply water to the dispenser 18 in the door 12. The water supply tube 20 penetrates through the hinge of the door 12 so as to transfer water from the main body 10 of the refrigerator to the door 12. Reference numeral 22 designates a hinge cover.

However, the related art refrigerator has the following problems.

That is, when the dispenser 18 is provided in the door 12, the water supply tube 20 for supplying the dispenser 18 with water and a power cable for transmitting an electrical signal to the dispenser are generally installed to penetrate through the hinge. In such a case, however, the door 12 cannot be designed such that it can be opened and/or closed on right and left sides. This is because the water supply tube 20 or power cable should be inserted into the interior of the door 12 prior to forming an insulating layer, when intending to manufacture the door 12.

SUMMARY OF THE INVENTION

The present invention is conceived to solve the aforementioned problems in the prior art. Accordingly, an object of the present invention is to provide a refrigerator door which can be selectively opened and/or closed on both right and left end sides even while including a dispenser.

Another object of the present invention is to provide a refrigerator door which can be selectively opened and/or closed on both right and left end sides in a state where a part such as an unused power cable is not exposed to the outside.

According to an aspect of the present invention for achieving the objects, there is provided a door for a refrigerator in which a direction of opening and/or closing the door can be selectively changed, comprising an external plate which defines at least a front appearance of the door; a door liner which defines a rear appearance of the door and constitutes a space with an insulating layer formed therein in cooperation with the external plate; a dispenser which is installed at a front surface of the external plate for dispensing water to the outside of the refrigerator; tube passages which pass through the insulating layer and allow the dispenser and through-holes for hinge installation located at both sides of the door to communicate with each other; a door side tube structure which is installed in at least one of the tube passages and transfers water from a main body of the refrigerator to the dispenser; and a power cable which extends from the dispenser to the respective through-holes and through which electrical signals are transmitted between the door and the main body of the refrigerator.

The door may further comprise decoration caps serving as a finishing trim at both upper and lower ends thereof, and wiring chambers for accommodating a tip end of the power cable therein may be formed in the respective decoration caps at locations adjacent to the through-holes.

Preferably, each wiring chamber is covered with a removable cover and a hook for catching and fastening a portion of the power cable is formed in the wiring chamber.

Preferably, the wiring chamber is formed to have a predetermined space defined by inwardly depressing the decoration cap.

More preferably, the wiring chamber is formed with a neck portion that is relatively narrower than other portions thereof, and the cover is formed with a neck portion corresponding to the neck portion of the wiring chamber.

Further, a hook for catching and fastening the power cable may be formed to protrude from a bottom surface of the wiring chamber.

Preferably, the door side tube structure and the power cable are installed through the tube passage.

More preferably, the door side tube structure and the power cable are installed in the insulating layer.

According to another aspect of the present invention, there is provided a door for a refrigerator in which a direction of opening and/or closing the door can be selectively changed, comprising an external plate which defines at least a front appearance of the door; a door liner which defines a rear appearance of the door and constitutes a space with an insulating layer formed therein in cooperation with the external plate; decoration caps which are provided at both upper and lower ends of the door and formed with through-holes for hinge installation at at least opposite sides of the decoration cap; a dispenser which is installed at a front surface of the external plate for dispensing water to the outside of the refrigerator; a door side tube structure which passes through the insulating layer and allow the dispenser and the through-holes to communicate with each other; and a power cable which is installed in the insulating layer to extend from the dispenser to the respective through-holes and through which electrical signals are transmitted between the door and the main body of the refrigerator.

Preferably, wiring chambers for accommodating a tip end of the power cable therein are formed in the respective decoration caps adjacent to the through-holes.

Preferably, each wiring chamber is covered with a removable cover and a hook for catching and fastening a portion of the power cable is formed in the wiring chamber.

More preferably, the wiring chamber is formed with a neck portion that is relatively narrower than other portions thereof, and the cover for covering the wiring chamber is formed with a neck portion corresponding to the neck portion of the wiring chamber.

Further, a hook for catching and fastening the power cable may be formed to protrude from a bottom surface of the wiring chamber.

Preferably, the door side tube structure is securely arranged in a tube passage formed in the insulating layer.

According to another aspect of the present invention, there is provided a door for a refrigerator in which a direction of opening and/or closing the door can be selectively changed, comprising an external plate which defines at least a front appearance of the door, a door liner which defines a rear appearance of the door and constitutes a space with an insulating layer formed therein in cooperation with the external plate, decoration caps which are provided at both upper and lower ends of the door and formed with through-holes for hinge installation at least opposite sides of the decoration cap, having wiring chambers formed in the respective decoration caps adjacent to the through-holes, and at least two power cable which are installed in the insulating layer to extend from the external plate to the respective through-holes, a tip end of the power cable are accommodated the wiring chambers and through which electrical signals are transmitted between the door and the main body of the refrigerator.

According to the present invention constructed as such, there are advantages in that the opening and/or closing direction of a refrigerator door with a dispenser can be easily changed, the external appearance of the door can be cleanly and neatly finished, and the door can be opened and/or closed without any hindrance due to the unused power cable.

The door may further comprise a dispenser which is installed at a front surface of the external plate for dispensing water to the outside of the refrigerator and a door side tube structure which passes through the insulating layer and allow the dispenser and the through-holes to communicate with each other.

Preferably, the door side tube structure is securely arranged in a tube passage formed in the insulating layer.

BRIEF DESCRIPTION OF THE DRAWINGS

The above and other objects, features and advantages of the present invention will become apparent from the following description of preferred embodiments given in conjunction with the accompanying drawings, in which.

DESCRIPTION OF THE PREFERRED EMBODIMENTS

Hereinafter, preferred embodiments of a door for a refrigerator according to the present invention will be described in detail with reference to the accompanying drawings.

Figure 1:
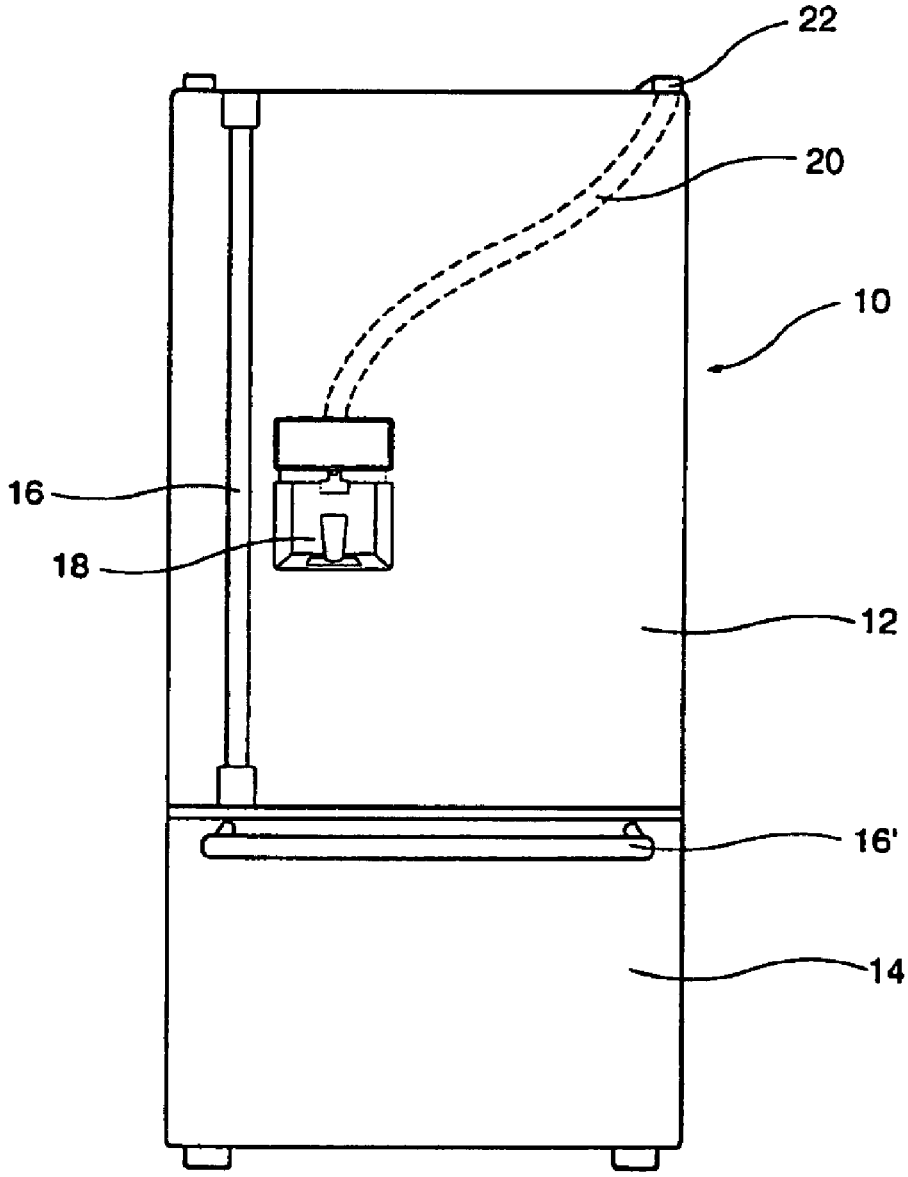
FIG. 1 is a front view of a related art refrigerator.
Figure 2:
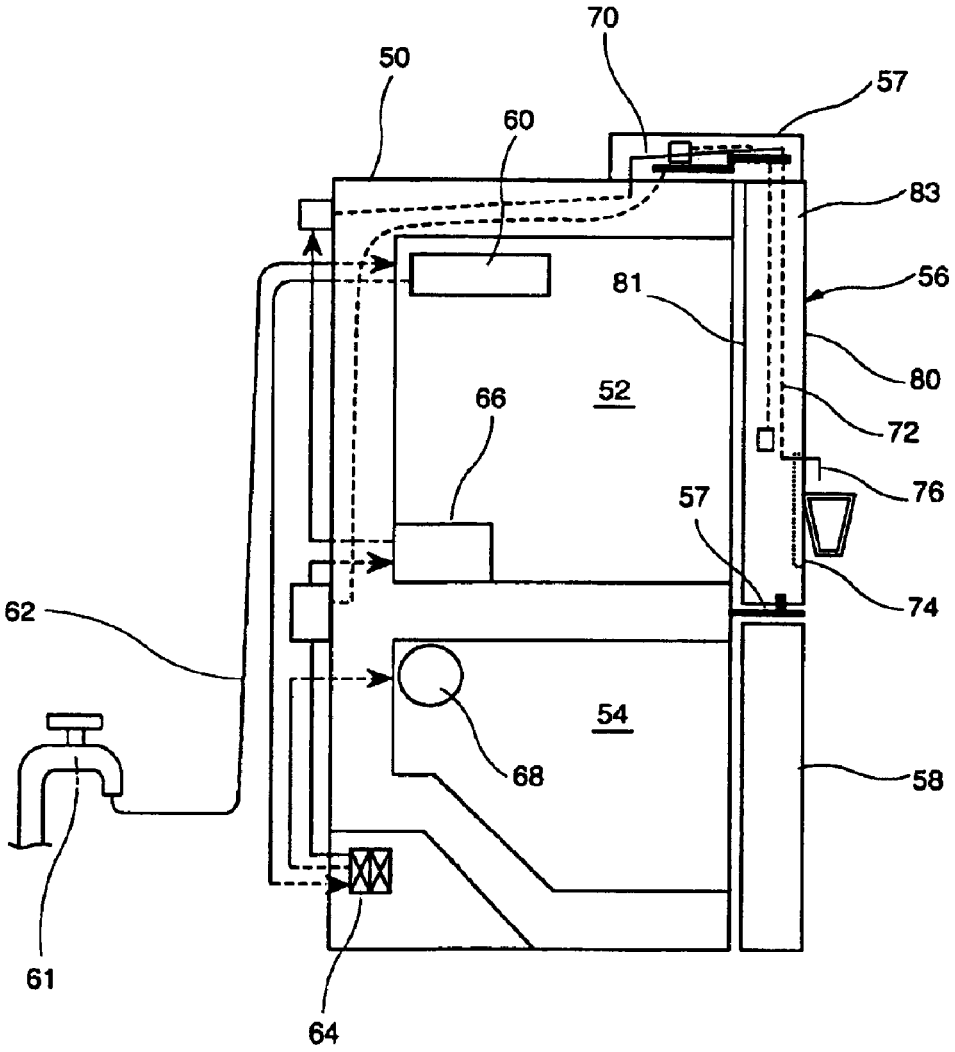
FIG. 2 is a side sectional view showing the configuration of a refrigerator in which a preferred embodiment of a door according to the present invention is employed.
Figure 3:
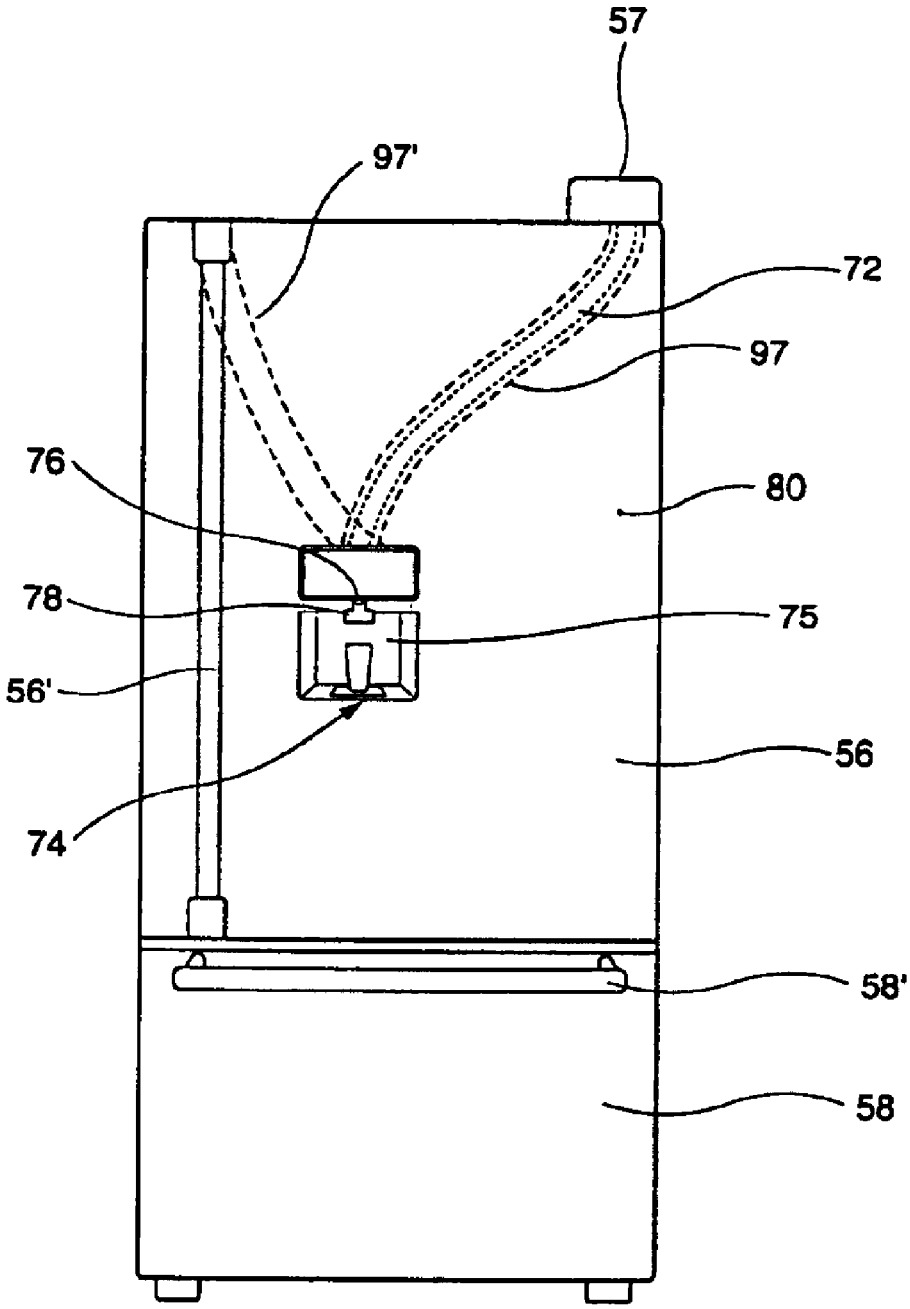
FIG. 3 is a front view of the refrigerator in which the preferred embodiment of the door according to the present invention is employed.
Figure 4:
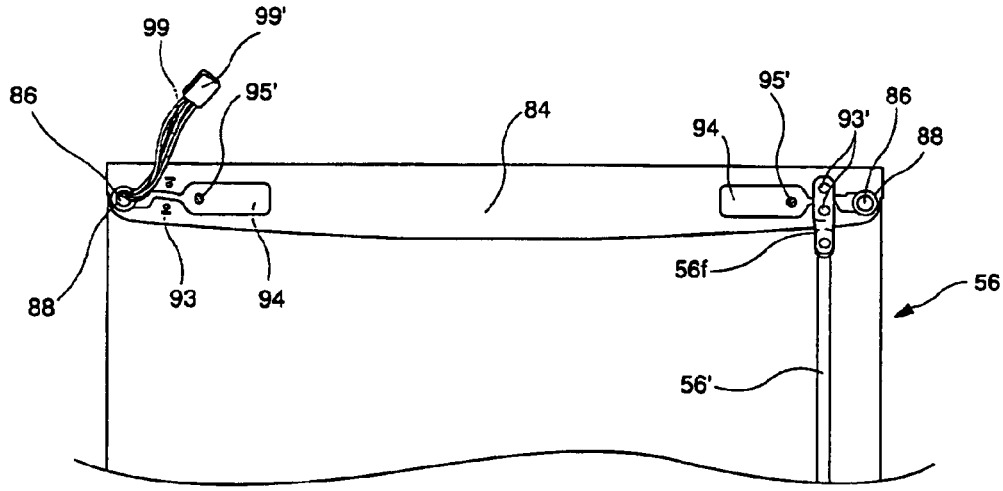
FIG. 4 is a partial perspective view of main portion of the refrigerator door according to the preferred embodiment of the present invention.
Figure 5:
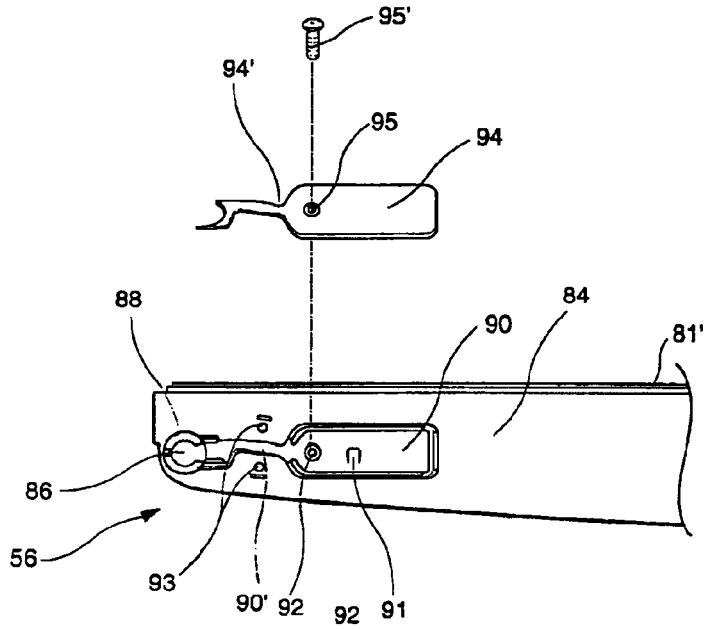
FIG. 5 is an exploded perspective view of the main portions of the refrigerator door according to the preferred embodiment of the present invention.

FIG. 2 is a sectional view showing the internal configuration of a refrigerator with a door according to a preferred embodiment of the present invention, and FIG. 3 is a front view showing the configuration of the refrigerator to which the door according to the preferred embodiment of the present invention is applied.

Referring to these figures, a main body 50 of the refrigerator is vertically divided into a refrigerating chamber 52 and a freezing chamber 54. The refrigerating chamber 52 is arranged at a relatively upper side of the main body 50 of the refrigerator, while the freezing chamber 54 is arranged at a relatively lower side of the main body.

The main body 50 of the refrigerator is provided with a refrigerating chamber door 56 and a freezing chamber door 58 for allowing the refrigerating chamber 52 and the freezing chamber 54 to be selectively opened and/or closed. According to this embodiment of the present invention, the refrigerating chamber door 56 is pivotally supported on the main body 50 of the refrigerator by a hinge 57 installed at right upper and lower ends as viewed from FIG. 3.

The doors 56 and 58 are provided with door handles 56' and 58', respectively. The door handles 56' and 58' are portions which users grasp to exert predetermined force for opening and/or closing the doors 56 and 58, respectively. The door handle 56' of the refrigerating chamber door 56 is mounted to a supporting bracket **56*f* fixed to a decoration cap 84** to be explained later.

A filter 60 is installed in the refrigerating chamber 52. The filter 60 serves to purify water. The water s supplied to the filter 60 through a water supply tube 62 connected to an external water supply source 61.

A valve 64 is provided at one side of the main body 50 of the refrigerator. The valve 64 serves to distribute the water, which has passed through the filter 64, to a water tank 66, an icemaker 68 and the like. The water tank 66 and the icemaker 68 are provided in the refrigerating chamber 52 and the freezing chamber 54, respectively. The water tank 66 serves to store the water that was purified through the filter 66, while the icemaker 68 manufacture ice from the water that was purified through the filter 60.

The main body 50 of the refrigerator is provided with a main body side tube structure 70 for transferring the water from the water tank 66 to the refrigerating chamber door 56. A leading end of the main body side tube structure 70 is exposed toward a top end of the main body 50 of the refrigerator and connected through the hinge 57 to a door side tube structure 72 installed in the refrigerating chamber door 56.

Furthermore, a dispenser 74 is provided at a front surface of the refrigerating chamber door 56. The dispenser 74 allows the water supplied from the water tank 66 to be discharged out of the refrigerating chamber door 56. The configuration of the dispenser 74 will now first be explained. A depressed portion 75 is formed on the front surface of the refrigerating chamber door 56 and a water dispensing port 76 is provided on a top surface of the depressed portion 75. The dispensing port 76 is connected to the door side tube structure 72. Although it is not shown in these figures, a valve is provided for regulating the discharge of water through the dispensing port 76. An actuating lever 78 is provided in the depressed portion 75. The actuating lever 78 controls the opening and/or closing of the valve so as to regulate the discharge of water through the dispensing port 76.

Next, the configuration of the refrigerating chamber door 56 will be described in detail. An external appearance of the refrigerating chamber door 56 is defined by an external plate 80 and a door liner 81. The external plate 80 defines an externally exposed portion, i.e. at least a front surface of the refrigerating chamber door 56. Preferably, the external plate can constitute both side surfaces and top and bottom surfaces of the door. The door liner 81 defines a rear surface of the refrigerating chamber door 56. A gasket 81' is also provided along an edge of the door liner 81. The gasket 81' comes into close contact with the front surface of the main body 50 of the refrigerator to prevent cold air from leaking out when the refrigerating chamber door 56 is closed.

An insulating layer 83 is formed in a space between the external plate 81 and the door liner 81. The insulating layer 83 is formed by causing a good insulation material to be foamed and cured between the external plate 80 and the door liner 81.

The decoration caps 84 are provided at the top and bottom ends of the refrigerating chamber door 56, respectively. Each of the decoration caps 84 functions as a finishing trim. Through-holes 86 are perforated at both ends of the decoration cap 84, respectively. A hinge bushing 88 is inserted into the through-hole 86 by a predetermined depth toward the refrigerating chamber door 56.

A wiring chamber 90 is formed to be depressed in each of the decoration cap 84. The wiring chamber 90 is formed by causing a portion of the decoration cap 84 to be depressed, but it is not necessarily formed in such a manner. Alternatively, the wiring chamber may pass through and be placed within the decoration cap 84. The wiring chamber 90 is connected to each of the through-holes 86 at both sides and extends toward the opposite through-hole 86.

A neck portion 90' is formed at one side of the wiring chamber 90 such that its width is smaller than other portions of the wiring chamber. The width of the neck portion 90' should be determined such that at least a power cable 99 accommodated in the wiring chamber 90 can be placed into the neck portion 90'. The power cable 99 and a connector 99' attached to an end of the power cable are accommodated in a relatively wide portion of the wiring chamber 90.

A hook 91 is formed to protrude from a bottom surface of the wiring chamber 90. The hook 91 is a portion where the power cable 99 is caught and fastened. The hook 91 is formed to face a side wall of the wiring chamber 90. A fastening boss 92 for fixing a cover 94 to be explained later is formed in the wiring chamber 90. The fastening boss 92 is formed with a female thread. Further, the fastening is preferably formed to protrude from the surface of the wiring chamber by a predetermined height.

A plurality of bracket-fastening holes 93 are formed in the decoration cap 84. At least four bracket-fastening holes 93 are formed in such a manner that at least one hole is provided at each end of the neck portion 90' of the wiring chamber 90. A supporting bracket **56*f* on which both ends of the door handle 56' are supported is fastened into the bracket-fastening holes 93 by means of fastening screws 93'**.

The wiring chamber 90 is covered with the cover 94 which in turn is securely fastened to an opening of the wiring chamber. To this end, it is preferred that a step portion be formed around an outer periphery of the opening of the wiring chamber 90. Therefore, the cover 94 has the same shape as that of the opening of the wiring chamber 90 and is thus provided with a neck portion 94 corresponding to the neck portion 90'. The cover 94 is formed with a fastening hole 95 at a position corresponding to the fastening boss 92 of the wiring chamber 90. A screw 95' is coupled to the fastening boss 92 through the fastening hole 95 such that the cover 94 is fixedly attached to the opening of the wiring chamber 90.

Furthermore, first and second tube passages 97 and 97' are formed such that they pass through the insulating layer 83 of the refrigerating chamber door 56. The tube passages 97 and 97' are used to communicate the dispenser 74 with the through-holes 86. As shown in FIG. 3, the first tube passage 97 communicates the dispenser 74 with the through-hole 86 located at the right upper end of the main body of the refrigerator, while the second tube passage 97' communicates the dispenser 74 with the through-hole 86 located at the left upper end of the main body of the refrigerator.

The door side tube structure 72 may be selectively provided in the first or second tube passage 97 or 97'. That is, the door side tube structure 72 is installed in the tube passage 97 or 97' which is in communication with the through-hole 86 that is connected to the hinge 57 according to the opening and/or closing direction of the refrigerating chamber door 56. In this embodiment of the present invention, the door side tube structure 72 is installed in the first tube passage 97.

On the other hand, the two door side tube structures 72 may be installed in the insulating layer 83 such that they allows the dispenser 74 to communicate with both through-holes 86 without using the tube passages 97 and 97'. But, the power cable 99 may be arranged through the tube passages 97 and 97'. Of course, the power cable 99 may be positioned within the insulating layer rather than the tube passage 97 and 97'. When the power cable 99 is installed within the insulating layer, the power cable must be extended to all the through-holes 86 located at both sides. At this time, the unused power cable 99 is neatly and securely arranged in the wiring chamber 90.

Hereinafter, an operation of the door for the refrigerator according to the present invention so configured will be described in detail.

A case where the refrigerating chamber door 56 is supported and installed at the left side by the hinge 57 as shown in FIG. 3 will be first explained. In such a case, the door side tube structure 72 is installed in the first tube passage 97 and then communicates with the main body side tube structure 70 through the hinge 57. Further, the power cable 99 passes through the hinge 57 and electrically connects with the main body 50 of the refrigerator and electric/electronic parts provided in the refrigerating chamber door 56.

Then, the supporting bracket **56*f* is fastened into the bracket-fastening hole 93 located at a side opposite to a side where the hinge 57 is installed, and the door handle 56' is installed at the supporting bracket. At this time, the power cable 99 extending through the through-hole 86 where the supporting bracket 56*f* is installed is securely arranged in the wiring chamber 90**.

Figure 6:
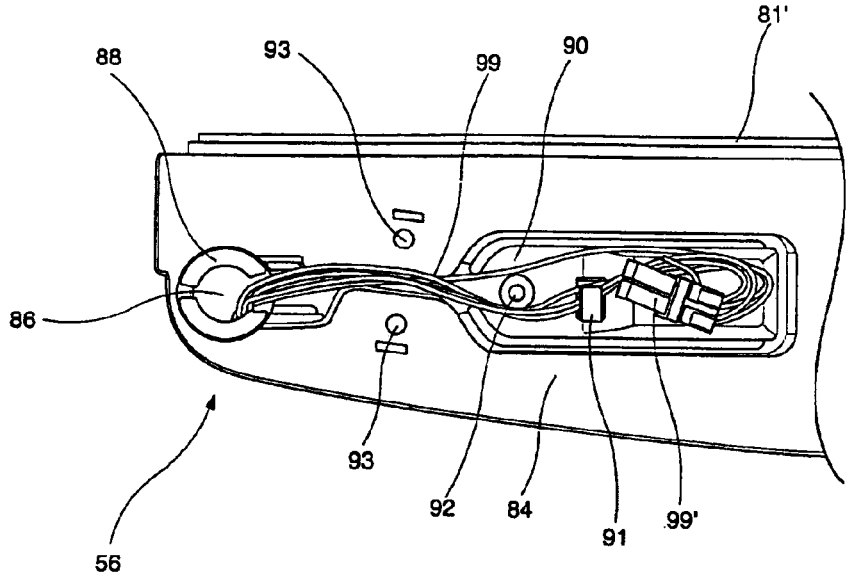
FIG. 6 is a view showing a state where a power cable is accommodated in a wiring chamber of the refrigerator door according to the further preferred embodiment of the present invention.

That is, after the cover 94 has been removed from the wiring chamber 90, the power cable 99 extending through the through-hole 86 is fitted into the neck portion 90' and then securely arranged in the wiring chamber 90. Further, the connector 99' attached to the end of the power cable 99 is neatly arranged in the relatively wide portion of the wiring chamber 90. At this time, a portion of the power cable 99 is caught around and fastened to the hook 91. Such a state is clearly shown in FIG. 6.

The wiring chamber 90 is covered with the cover 94 regardless of whether the power cable 99 is used or not, i.e. whether the power cable 99 is securely arranged in the wiring chamber 90. The cover 94 is mounted to the wiring chamber 90 by screwing the screw 95' into the fastening boss 92 through the fastening hole 95.

The power cable 99 to be used, i.e. the power cable located at the right side in this embodiment of the present invention, is extended out from the through-hole 86 through the hinge 57.

In the meantime, if a manufacturer or user intends to reverse the direction of opening and/or closing the refrigerating chamber door 56, the door side tube structure 72 is pulled out from the first tube passage 97 and inserted into the second tube passage 97' through the hinge bushing 88 and through-hole 86.

Subsequently, the power cable 99, which was extended to the outside of the refrigerating chamber door 56 through the right through-hole 86, is securely arranged in the right wiring chamber 90, and then, another power cable 99 is drawn out from the left wiring chamber 90. Then, the respective wiring chambers 90 are covered with covers 94.

Thereafter, the fastening screw 93' that is used to fasten the supporting bracket **56*f* to the decoration cap 84 is unscrewed, and the supporting bracket 56*f* and the door handle 56' are shifted to a desired right location. That is, the supporting bracket 56*f* is fastened to the bracket-fastening hole 93 formed on the right decoration cap 84**.

Figure 7:
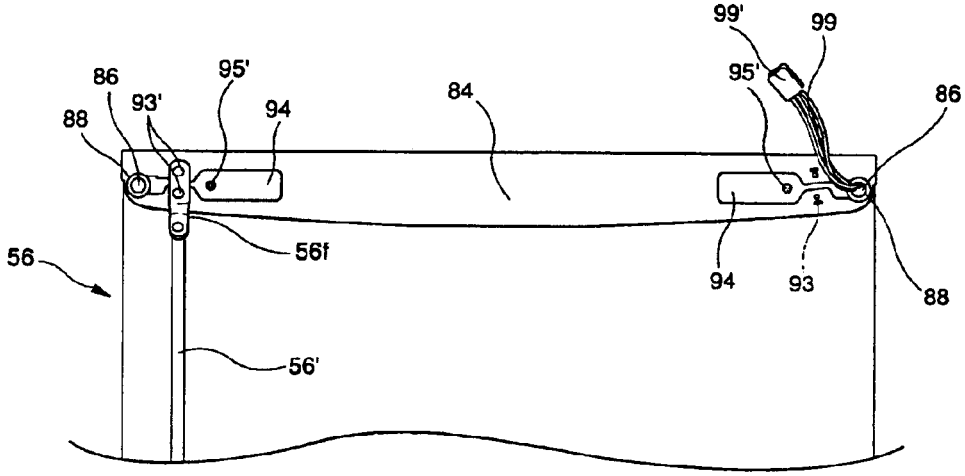
FIG. 7 is a partial perspective view of main portions of a refrigerator door which is opened and/or closed in a direction opposite to the opening/closing direction of the door according to another preferred embodiment of the present invention.

If the configuration of the refrigerating chamber door 56 is changed as described above, the refrigerating chamber door 56 can be opened and/or closed in a reverse direction by mounting the door to the main body 50 of the refrigerator. Such a mounting state is shown in FIG. 7. That is, as shown in this figure, the refrigerating chamber door 56 is configured in such a manner that its left side is pivotally supported by the hinge 57 while its right side comes into close contact with or is separated from the front face of the main body 50 of the refrigerator to open and/or close the refrigerating chamber 52.

In the meantime, when manufacturing the refrigerating chamber door 56, a generally V-shaped hose is embedded therein so as to form the tube passages 97 and 97'. That is, the V-shaped hose, into which the door side tube structure 72 can be inserted such that its lower end communicates with the dispenser 74 and its upper end communicates with the hinge bushing 88 provided at both upper sides of the refrigerating chamber door 56, is inserted between a space defined between the external plate 80 and door liner 81 of the refrigerating chamber door 56 and a foam liquid is then filled in the interior of the refrigerating chamber door 56. Therefore, the V-shaped hose can constitute the tube passages 97 and 97'.

Next, it is described how water is dispensed through the dispenser 74 installed in the refrigerating chamber door 56. Water is supplied from the external water supply source 61 to the filter 60 of the main body 50 of the refrigerator through the water supply tube 62. The water purified in the filter 60 is supplied to both the water tank 66 and icemaker 68 through the valve 64.

The water that is temporarily stored in the water tank 66 is supplied to the door side tube structure 72 in the refrigerating chamber door 56 through the main body side tube structure 70 when the user intends to draw water out from the dispenser 74. At this time, the main body side tube structure 70 and the door side tube structure 72 communicate with each other via the hinge 57. The water supplied in the door side tube structure 72 of the refrigerating chamber door 56 is dispensed through the water dispensing port 76 when the user operates the actuating lever 78 installed in the dispenser 74.

As specifically described above, a door for a refrigerator according to the present invention has the following advantageous effects.

First, even when a user intends to change the direction of opening and/closing the refrigerator door, a door side tube structure can be easily shifted from one tube passage to another tube passages. Thus, the door opening/closing direction can be easily changed in the refrigerator with a dispenser.

Further, a refrigerator of which door opening/closing direction can be selectively changed can be configured in such a manner that an unused power cable is not exposed to the outside. Thus, an external appearance of the door is clean and neat, and moisture can be prevented from being transferred to the power cable.

Furthermore, the unused power cable can be prevented from being broken or being a hindrance to the door opening and/or closing.

Although the present invention has been described in connection with the preferred embodiments. It will be apparent to those skilled in the art that various changes and modifications can be made thereto without departing from the scope and spirit of the present invention. Therefore, the embodiments should be considered as not restrictive but illustrative. Further, the true scope of the present invention is defined by the appended claims, and changes and modifications should be constructed as falling within the scope of the present invention.

What is claimed is:

1. A door for a refrigerator in which a direction of opening and/or closing the door can be selectively changed, comprising:

an external plate which defines at least a front appearance of the door;

a door liner which defines a rear appearance of the door and constitutes a space with an insulating layer formed therein in cooperation with the external plate;

a dispenser which is installed at a front surface of the external plate for dispensing water to the outside of the refrigerator;

tube passages which pass through the insulating layer and allow the dispenser and through-holes for hinge installation located at both sides of the door to communicate with each other;

a door side tube structure which is installed in at least one of the tube passages and transfers water from a main body of the refrigerator to the dispenser; and a power cable which extends from the dispenser to the respective through-holes and through which electrical signals are transmitted between the door and the main body of the refrigerator.

2. The door as claimed in claim 1, further comprising decoration caps serving as a finishing trim at both upper and lower ends of the door, wherein wiring chambers for accommodating a tip end of the power cable therein are formed in the respective decoration caps at locations adjacent to the through-holes.

3. The door as claimed in claim 2, wherein each of the wiring chambers is covered with a removable cover.

4. The door as claimed in claim 2, wherein the wiring chamber is formed to have a predetermined space defined by inwardly depressing the decoration cap.

5. The door as claimed in claim 3, wherein the wiring chamber is formed with a neck portion that is relatively narrower than other portions thereof, and the cover for covering the wiring chamber is formed with a neck portion corresponding to the neck portion of the wiring chamber.

6. The door as claimed in claim 2, wherein a hook for catching and fastening the power cable is formed to protrude from a bottom surface of the wiring chamber.

7. The door as claimed in claim 1, wherein the door side tube structure and the power cable are installed through the tube passage.

8. The door as claimed in claim 1, wherein the door side tube structure and the power cable are installed in the insulating layer.

9. A door for a refrigerator in which a direction of opening and/or closing the door can be selectively changed, comprising:

an external plate which defines at least a front appearance of the door;

a door liner which defines a rear appearance of the door and constitutes a space with an insulating layer formed therein in cooperation with the external plate;

decoration caps which are provided at both upper and lower ends of the door and formed with through-holes for hinge installation at at least opposite sides of the decoration cap;

a dispenser which is installed at a front surface of the external plate for dispensing water to the outside of the refrigerator;

a door side tube structure which passes through the insulating layer and allow the dispenser and the through-holes to communicate with each other; and a power cable which is installed in the insulating layer to extend from the dispenser to the respective through-holes and through which electrical signals are transmitted between the door and the main body of the refrigerator.

10. The door as claimed in claim 9, wherein wiring chambers for accommodating a tip end of the power cable therein are formed in the respective decoration caps adjacent to the through-holes.

11. The door as claimed in claim 10, wherein each of the wiring chambers is covered with a removable cover and a hook for catching and fastening a portion of the power cable is formed in the wiring chamber.

12. The door as claimed in claim 11, wherein the wiring chamber is formed with a neck portion that is relatively narrower than other portions thereof, and the cover for covering the wiring chamber is formed with a neck portion corresponding to the neck portion of the wiring chamber.

13. The door as claimed in claim 10, wherein a hook for catching and fastening the power cable is formed to protrude from a bottom surface of the wiring chamber.

14. The door as claimed in claim 10, wherein the door side tube structure is securely arranged in a tube passage formed in the insulating layer.

15. A door for a refrigerator in which a direction of opening and/or closing the door can be selectively changed, comprising:

an external plate which defines at least a front appearance of the door;

a door liner which defines a rear appearance of the door and constitutes a space with an insulating layer formed therein in cooperation with the external plate;

decoration caps which are provided at both upper and lower ends of the door and formed with through-holes for hinge installation at least opposite sides of the decoration cap, having wiring chambers formed in the respective decoration caps adjacent to the through-holes; and at least two power cable which are installed in the insulating layer to extend from the external plate to the respective through-holes, a tip end of the power cable are accommodated the wiring chambers and through which electrical signals are transmitted between the door and the main body of the refrigerator.

16. The door as claimed in claim 15, further comprising a dispenser which is installed at a front surface of the external plate for dispensing water to the outside of the refrigerator and a door side tube structure which passes through the insulating layer and allow the dispenser and the through-holes to communicate with each other.

17. The door as claimed in claim 16, wherein the door side tube structure is securely arranged in a tube passage formed in the insulating layer.

18. The door as claimed in claim 15, wherein each of the wiring chambers is covered with a removable cover and a hook for catching and fastening a portion of the power cable is formed in the wiring chamber.

* * * * *